US010630015B2

(12) United States Patent
Huo et al.

(10) Patent No.: US 10,630,015 B2
(45) Date of Patent: Apr. 21, 2020

(54) PLUG CONNECTOR AND SOCKET CONNECTOR

(71) Applicant: SHENZHEN DEREN ELECTRONIC CO., LTD., Shenzhen (CN)

(72) Inventors: Zhudong Huo, Shenzhen (CN); Wang Sun, Shenzhen (CN)

(73) Assignee: SHENZHEN DEREN ELECTRONIC CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/241,365

(22) Filed: Jan. 7, 2019

(65) Prior Publication Data

US 2019/0140385 A1 May 9, 2019

Related U.S. Application Data

(63) Continuation of application No. PCT/CN2017/096234, filed on Aug. 7, 2017.

(30) Foreign Application Priority Data

Nov. 18, 2016 (CN) ..... 2016 2 1242204 U

(51) Int. Cl.

| | |
|---|---|
| ***H01R 13/42*** | (2006.01) |
| ***H01R 13/502*** | (2006.01) |
| ***H01R 13/447*** | (2006.01) |
| ***H01R 13/506*** | (2006.01) |
| ***H01R 13/6582*** | (2011.01) |
| ***H01R 13/436*** | (2006.01) |
| *H01R 12/71* | (2011.01) |
| *H01R 24/60* | (2011.01) |

(52) U.S. Cl.

CPC ..... *H01R 13/42* (2013.01); *H01R 13/436* (2013.01); *H01R 13/447* (2013.01);
(Continued)

(58) Field of Classification Search

CPC .... H01R 13/42; H01R 13/447; H01R 13/502; H01R 13/5025; H01R 13/5045; H01R 13/506; H01R 13/508
(Continued)

(56) References Cited

U.S. PATENT DOCUMENTS

| | | | |
|---|---|---|---|
| 6,402,554 | B1 | 6/2002 | Yeh |
| 8,747,142 | B2 | 6/2014 | Zhang et al. |

(Continued)

FOREIGN PATENT DOCUMENTS

| | | | |
|---|---|---|---|
| CN | 2399853 | Y | 10/2000 |
| CN | 2484658 | Y | 4/2002 |

(Continued)

OTHER PUBLICATIONS

International Search Report dated Apr. 27, 2018; PCT/CN2017/096234.

*Primary Examiner* — Harshad C Patel
(74) *Attorney, Agent, or Firm* — IPro, PLLC

(57) ABSTRACT

A plug connector includes an insulating body, a first plug conductive terminal set and a second plug conductive terminal set. The insulating body includes a base portion, a tongue plate, at least two projections and a stopper block. The tongue plate extends onward from the base portion, the at least two projections extend from two sidewalls of the tongue plate, and the stopper block is positioned on an inner side of one of the at least two projections. The first plug conductive terminal set is fixed upon one side of the tongue plate. The second plug conductive terminal set is fixed upon the other side of the tongue plate.

20 Claims, 6 Drawing Sheets

(52) U.S. Cl.
CPC ..... *H01R 13/502* (2013.01); *H01R 13/506* (2013.01); *H01R 13/6582* (2013.01); *H01R 12/716* (2013.01); *H01R 24/60* (2013.01)

(58) Field of Classification Search
USPC .... 439/686, 607.01, 607.07, 607.09, 607.11, 439/607.13, 607.14, 607.2, 607.21, 439/607.22, 607.23, 607.24, 607.26, 439/607.31, 607.32, 607.33, 607.35, 439/607.38, 607.4, 607.43, 607.53, 687, 439/695–697, 701, 706, 712, 818, 846
See application file for complete search history.

(56) References Cited

U.S. PATENT DOCUMENTS

| | | | | |
|---|---|---|---|---|
| 9,379,494 | B1 * | 6/2016 | Hu | H01R 13/6594 |
| 2013/0084732 | A1 | 4/2013 | Zhang et al. | |
| 2013/0237093 | A1 * | 9/2013 | Kamarauskas | H01R 13/2442 439/607.58 |
| 2014/0213091 | A1 * | 7/2014 | Hsu | H01R 12/724 439/345 |
| 2016/0285209 | A1 * | 9/2016 | Peng | H01R 13/6585 |
| 2016/0315424 | A1 * | 10/2016 | Tsai | H01R 13/6581 |

FOREIGN PATENT DOCUMENTS

| | | | |
|---|---|---|---|
| CN | 201207516 | Y | 3/2009 |
| CN | 103036106 | A | 4/2013 |
| CN | 202906113 | U | 4/2013 |
| CN | 104733903 | A | 6/2015 |
| CN | 206163779 | U | 5/2017 |
| TW | 422435 | U | 2/2001 |
| TW | 516728 | U | 1/2003 |
| TW | 201315029 | A | 4/2013 |
| TW | I479749 | B | 4/2015 |

* cited by examiner

PLUG CONNECTOR AND SOCKET CONNECTOR

CROSS-REFERENCE TO RELATED APPLICATIONS

This disclosure is a continuation of International Patent Application No. PCT/CN2017/096234, filed on Aug. 7, 2017, which is based upon and claims priority to Chinese Patent Application No. 201621242204.7, filed on Nov. 18, 2016, the entire contents of which are incorporated herein by reference.

TECHNICAL FIELD

The present disclosure relates to the technical field of connector, and in particular, relates to plug connectors and a socket connector.

BACKGROUND

An electrical connector component, also known as a circuit connector, is a conductive device used to bridge two conductors in one loop, so that current or a signal can flow from one conductor to another conductor. The electrical connector component is widely used in various electrical circuits and plays a role of connecting or disconnecting current or a signal.

At present, the electrical connector component includes a plug connector and a socket connector. The socket connector is generally assembled on a print circuit board, and the plug connector is assembled on a line terminal. When the socket connector and the plug connector are jointed, the printed circuit board and the line terminal are electrically connected. However, in an actual use process, the socket connector and the plug connector may be inserted obliquely or reversely. When the socket connector and the plug connector are inserted obliquely, a terminal of the socket connector may be connected to a metal shell of the plug connector, or, a terminal of the plug connector may be connected to a metal shell of the socket connector, resulting in a short circuit and affecting transmission of the electrical connector component. When the socket connector and the plug connector are inserted reversely, a signal cannot be transmitted, and the connectors may be damaged due to overexertion during insertion.

SUMMARY

An embodiment of the present disclosure provides a plug connector, which includes an insulating body, including a base portion, a tongue plate, at least two projections and a stopper block; wherein the tongue plate extends onward from the base portion, the at least two projections extend from two sidewalls of the tongue plate, and the stopper block is positioned on an inner side of one of the at least two projections; a first plug conductive terminal set, fixed upon one side of the tongue plate; and a second plug conductive terminal set, fixed upon the other side of the tongue plate.

Another embodiment of the present disclosure provides a plug connector, which includes an insulating body, including a base portion, a tongue plate, at least two projections and a stopper block; wherein the tongue plate extends onward from the base portion, the at least two projections extend from two sidewalls of the tongue plate, the stopper block is positioned on an inner side of one of the at least two projections, and a height of the stopper block is lower than a height of the projection adjacent to the stopper block; a first plug conductive terminal set, fixed upon one side of the tongue plate; and a second plug conductive terminal set, fixed upon the other side of the tongue plate.

Still another embodiment of the present disclosure provides a plug connector, which includes: an insulating body, including a base portion, a tongue plate and at least four projections; wherein, the tongue plate extend from the base portion, and the at least four projections respectively extend from two sidewalls of the tongue plate in two opposite directions; a first plug conductive terminal set, located on one side of the tongue plate; a second plug conductive terminal set, located on the other side of the tongue plate; and a plug metal shell, fastened to the insulating body, wherein the plug metal shell includes a plug reinforcing portion, the plug reinforcing portion is fastened to at least one projection, and extends to an internal lateral surface of the at least one projection.

BRIEF DESCRIPTION OF DRAWINGS

One or more embodiments are illustrated by way of example, and not by limitation, in the figures of the accompanying drawings, wherein components having the same reference numeral designations represent like components throughout. The drawings are not to scale, unless otherwise disclosed.

DETAILED DESCRIPTION

For better understanding of the present disclosure, the present disclosure is described in detail with reference to attached drawings and specific embodiments. It should be noted that, when an element is defined as "being secured or fixed to" another element, the element may be directly positioned on the element or one or more centered elements may be present there between. When an element is defined as "being connected or coupled to" another element, the element may be directly connected or coupled to the element or one or more centered elements may be present there between. As used herein, the terms "vertical", "horizontal", "left", "right", and similar expressions are merely for illustration purposes.

Unless otherwise defined, all the technical and scientific terms used in this specification have same meanings as those generally understood by a person of ordinary skill in the technical field to which this disclosure pertains. The terms used in the specification of the present disclosure are merely intended to describe specific embodiments rather than limiting the present disclosure.

Figure 1:
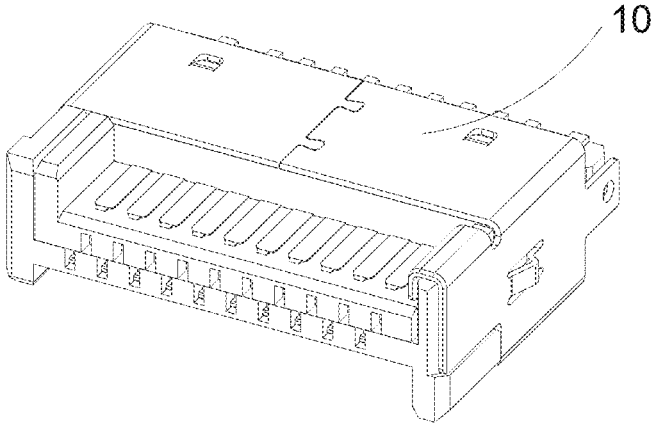
FIG. 1 is a perspective view of a plug connector according to a first embodiment of the present disclosure.
Figure 2:
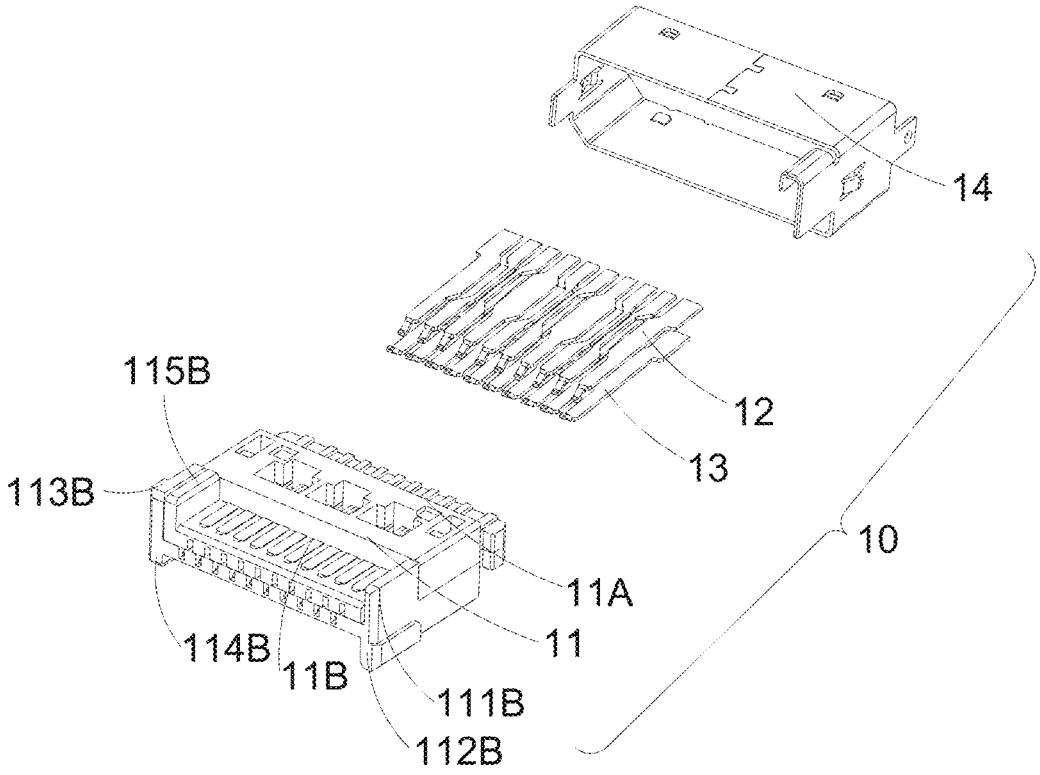
FIG. 2 is a space exploded view of the plug connector according to the first embodiment of the present disclosure.
Figure 3:
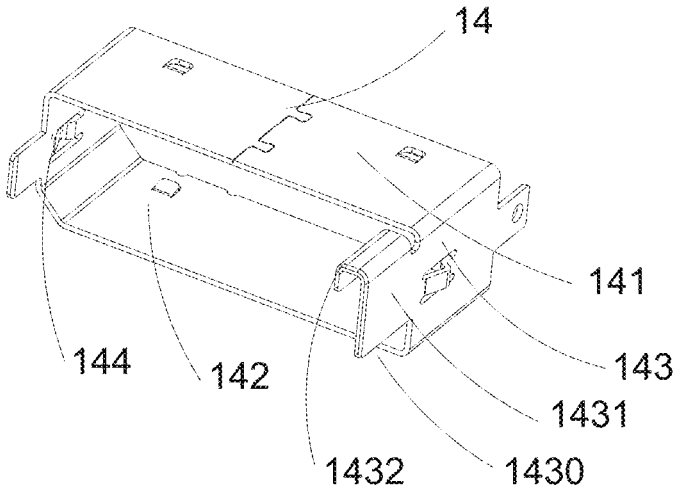
FIG. 3 is a structural diagram of a plug metal shell of the plug connector according to the first embodiment of the present disclosure.

Referring to FIG. 1 to FIG. 3, FIG. 1 is a perspective view of a plug connector according to a first embodiment of the present disclosure, FIG. 2 is a space exploded view of the plug connector, and FIG. 3 is a structural diagram of a plug metal shell of the plug connector. The plug connector 10 in this embodiment includes an insulating body 11, a first plug conductive terminal set 12, a second plug conductive terminal set 13, and a plug metal shell 14. The insulating body 11 includes a base portion 11A and a tongue plate 11B extending from the base portion 11A. There are at least four projections respectively extending from two sidewalls of the tongue plate in two opposite directions, for example, projections 111B, 112B, 113B, 114B, and 115B shown in FIG. 2. The first plug conductive terminal set 12 is located on one side of the tongue plate 11B, and the second plug conductive terminal 13 set is located on the other side of the tongue plate 11B. The plug metal shell 14 is fastened to the insulating body 11. The plug metal shell 14 includes a plug reinforcing portion 1432 that is fastened to at least one projection, and the plug reinforcing portion 1432 extends to an internal lateral surface of the at least one projection.

The plug metal shell 14 includes an upper wall 141, a lower wall 142, two sidewalls 143 and 144, and an extension portion. The extension portion is positioned on at least one of the two sidewalls and is fastened to an external lateral surface of a projection. The plug reinforcing portion 1432 bends and extends towards the internal lateral surface of the projection from the extension portion and sticks to the internal lateral surface of the projection. As shown in FIG. 3, an extension portion 1431 is positioned on the sidewall 143 and is fastened to an external lateral surface of the projection 111B, and the plug reinforcing portion 1432 bends and extends towards an internal lateral surface of the projection 111B from the extension portion 1431 and sticks to the internal lateral surface of the projection 111B. In this embodiment, the plug reinforcing portion 1432 extends to a surface of the tongue plate 11B along the internal lateral surface of the projection 111B. In other embodiments, in order to further strengthen a fastening effect of the plug reinforcing portion 1432 on the projection 111B, a common fastening structure such as a buckling hole and a buckling portion, may also be applied between the plug reinforcing portion 1432 and the internal lateral surface of the projection 111B. In implementation, the insulating body is usually plastic. In order to reduce damages to the plastic in case of reverse insertion or interconnection, the extension portion 1431 extends to a tail end of the projection 111B.

Figure 4:
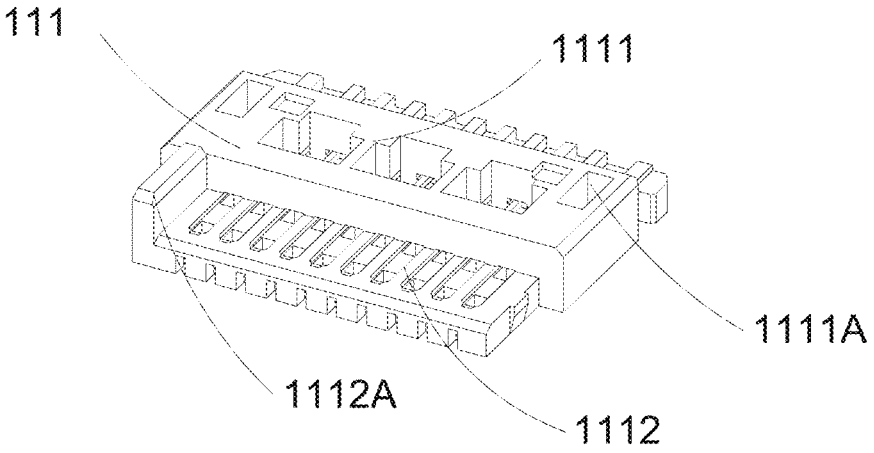
FIG. 4 is a structural diagram of a first insulating body of the plug connector according to the first embodiment of the present disclosure.
Figure 5:
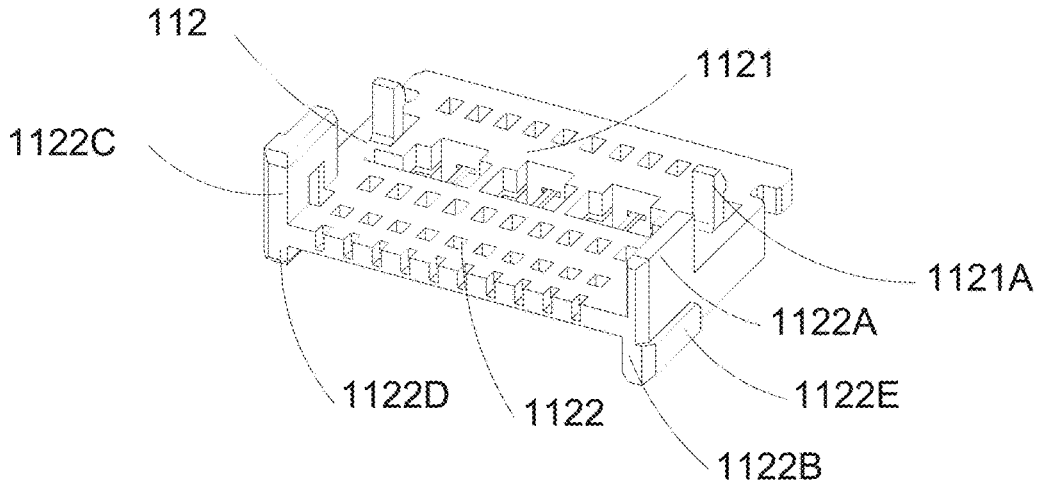
FIG. 5 is a structural diagram of a second insulating body of the plug connector according to the first embodiment of the present disclosure.

The insulating body 11 of the plug connector in this embodiment may be an integrally formed structure. To facilitate preparation by injection molding, the insulating body may also include a first insulating body and a second insulating body. As shown in FIG. 4, a first insulating body 111 includes a first base portion 1111 and a first tongue plate 1112 extending from the first base portion 1111. As shown in FIG. 5, a second insulating body 112 includes a second base portion 1121 and a second tongue plate 1122 extending from the second base portion 1121. The first plug conductive terminal set 12 is located on the first tongue plate 1112, and the second plug conductive terminal set 13 is located on the second tongue plate 1122. The insulating body 11 further includes four projections 1122A, 1122B, 1122C, and 1122D respectively extending from two sidewalls of the second tongue plate 1122 in two opposite directions. The plug reinforcing portion 1432 is fastened to one of the four projections.

In an embodiment, the plug reinforcing portion 1432 is fastened to the projection 1122A of the four projections. The plug reinforcing portion 1432 extends from one side of the extension portion 1431 until covering the projection 1122A and then extends towards an internal lateral surface of the projection 1122A. A front end of the extension portion 1431 does not exceed a front end of the projection 1122A, the other side of the extension portion 1431 and the sidewall on which the extension portion 1431 is positioned define a fastening hole 1430, and a fastening portion 1122E that matches the fastening hole 1430 is positioned on a sidewall of the second tongue plate 1122, so that the plug metal shell 14 and the insulating body are better fastened.

After the first insulating body 111 and the second insulating body 112 are buckled and connected together, the first tongue plate 1112 is housed between two projections on the second tongue plate 1122 that extend toward a same direction, such as 1122A and 1122C shown in FIG. 5. A front end of the first base portion 1111 abuts against the two projections.

The insulating body 11 further includes a stopper block 1112A positioned on the first tongue plate 1112. In fact, the stopper block 1112A may be a projection extending from a sidewall of the first tongue plate 1112. The stopper block 1112A closely sticks to one of the two projections against which the front end of the first base portion 1111 abuts, and the stopper block 1112A further defines a stopper space together with a projection adjacent to the stopper block 1112A. Wherein, a height of the stopper block 1112A is lower than a height of the projection adjacent to the stopper block 1112A, or flushes with the projection adjacent to the stopper block 1112A. The plug reinforcing portion 1432 is fastened to a projection located opposite to the stopper block 1112A. That is, the plug reinforcing portion 1432 is fastened to a projection that is positioned horizontally or vertically opposite to the stopper block 1112A.

In some embodiments, the first insulating body 111 defines at least one snap-joint hole 1111A, and the second insulating body 112*a* includes a snap-joint rod 1121A that matches the snap-joint hole 1111A. The snap-joint rod 1121A snaps into the snap-joint hole 1111A to fasten the first insulating body 111 and the second insulating body 112 as a whole, thereby facilitating assembly. Alternatively, the first insulating body 111 and the second insulating body 112 may be fastened as a whole by using thermal adhesion or other manners.

In some embodiments, a central location of the first base portion 1111 defines three first clearance holes that penetrate through the first base portion 1111, a central location of the second base portion 1112 defines three second clearance holes that penetrate through the second base portion 1112, and locations of the first clearance holes correspond to locations of the second clearance holes. Each of the first plug conductive terminal set 12 and the second plug conductive terminal set 13 includes a plurality of high-speed signal terminals, and the high-speed signal terminals are exposed in the first clearance holes and the second clearance holes, thereby improving a transmission rate of the high-speed signal terminals.

Figure 6:
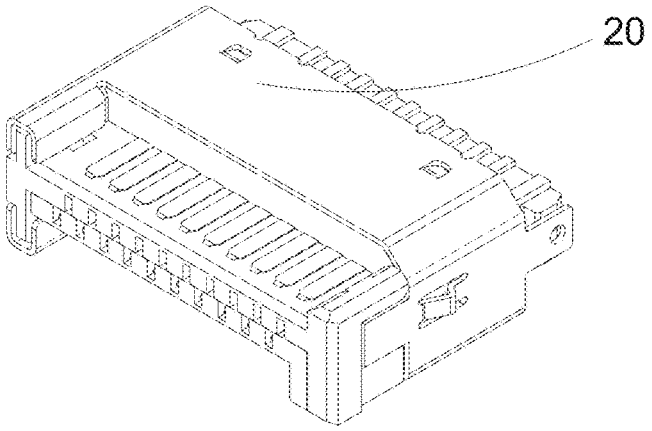
FIG. 6 is a perspective view of a plug connector according to a second embodiment of the present disclosure.
Figure 7:
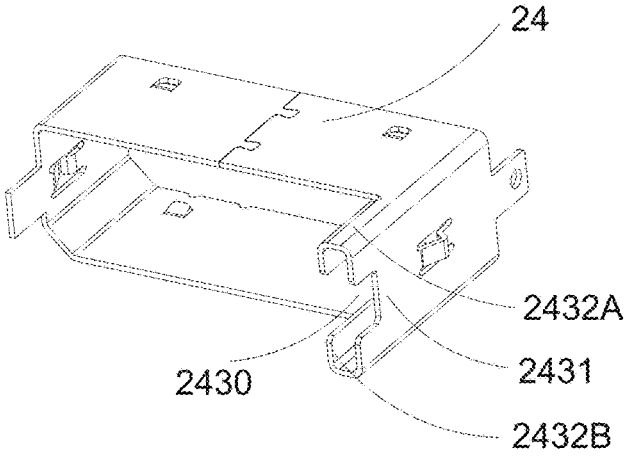
FIG. 7 is a structural diagram of a plug metal shell of the plug connector according to the second embodiment of the present disclosure.

Referring to FIG. 6, FIG. 6 is a perspective view of a plug connector according to a second embodiment of the present disclosure. The plug connector 20 is different from the plug connector 10 of the first embodiment in that, as shown in FIG. 7, a plug metal shell 24 includes two plug reinforcing portions 2432A and 2432B. The plug reinforcing portions 2432A and 2432B are fastened to two projections. In this embodiment, there are two projections extend towards opposite directions from a same sidewall of a tongue plate. The two plug reinforcing portions 2432A and 2432B bend and extend toward opposite directions from an extension portion 2431 of a same sidewall of the plug metal shell 24, and stick to internal lateral surfaces of the two projections, so that the plug metal shell and an insulating body are combined more closely. In another embodiment, alternatively, the two plug reinforcing portions may not bend and extend from the extension portion of the same sidewall, for example, the two plug reinforcing portions may stick to internal lateral surfaces of two projections that are positioned diagonally on different sidewalls of a tongue plate. This embodiment sets no limitation thereto.

Figure 8:
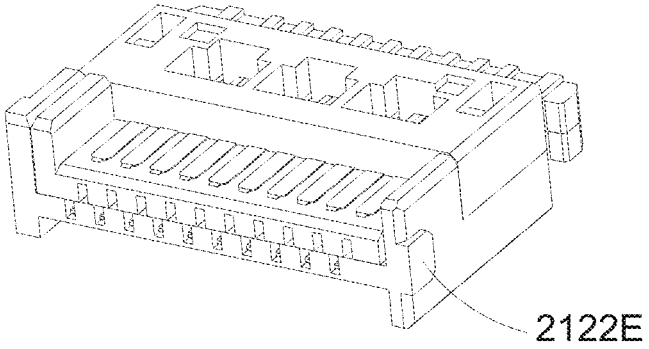
FIG. 8 is a structural diagram of an insulating body of the plug connector according to the second embodiment of the present disclosure.
Figure 9:
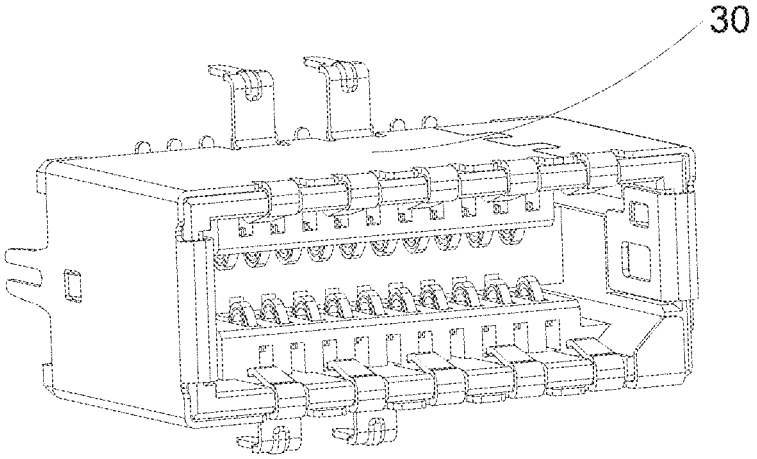
FIG. 9 is a perspective view of a socket connector according to an embodiment of the present disclosure.

The two plug reinforcing portion 2432A and 2432B extend from two sides of the extension portion 2431 until covering the two projections and then extend towards the internal lateral surface of the two projections. A front end of the extension portion 2431 does not exceed front ends of the two projections. A fastening hole 2430 with an opening at a front end is defined on the extension portion 2431, and a fastening portion 2122E that matches the fastening hole 2430 is positioned at a front end of a sidewall of a second tongue plate, as shown in FIG. 8. In another embodiment, if the plug reinforcing portions are fastened to two projections, among the four projections, that are located on different sidewalls of the tongue plate and are positioned diagonally, for disposition of a fastening hole and a fastening portion, refer to disposition in the first embodiment.

Figure 10:
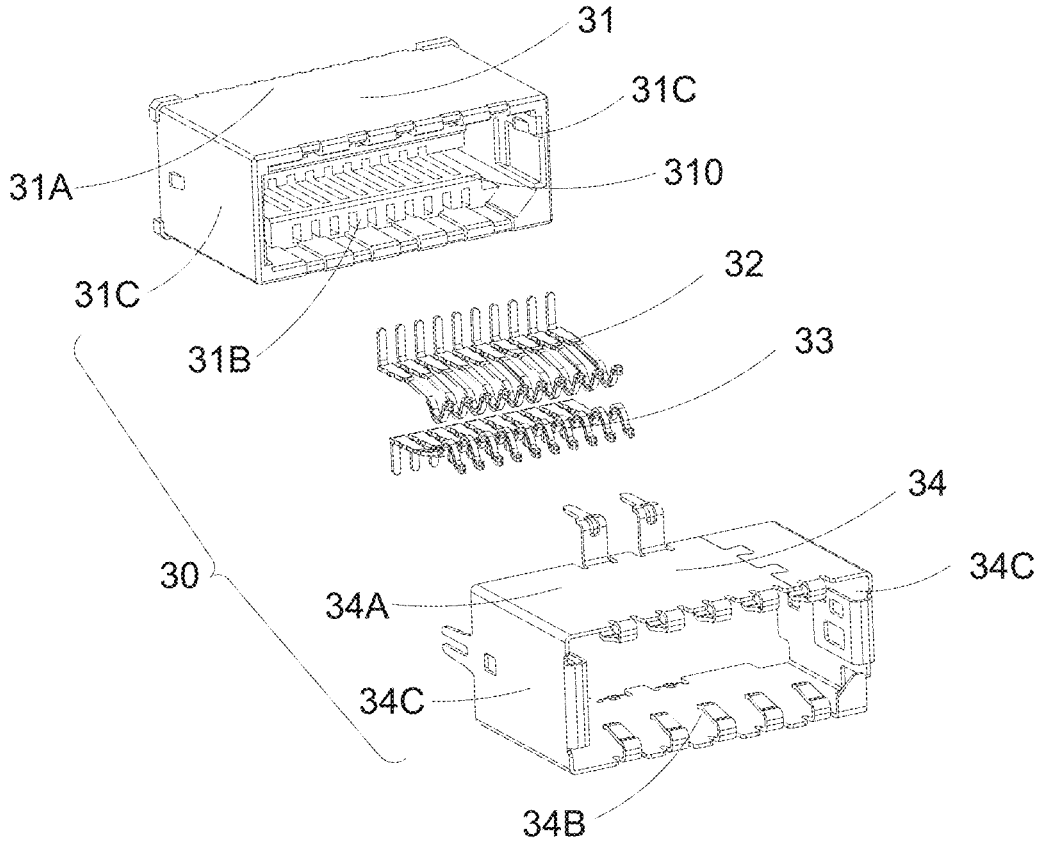
FIG. 10 is a space exploded view of the socket connector shown in FIG. 9 according to the embodiment of the present disclosure.
Figure 11:
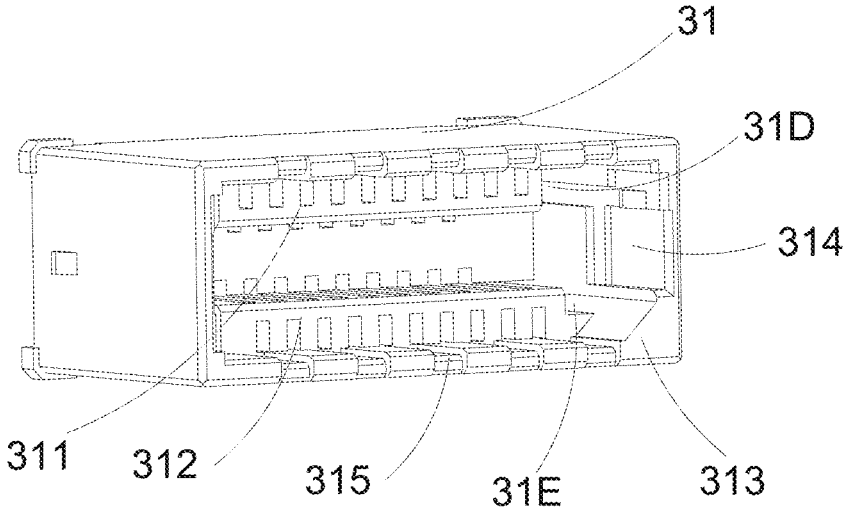
FIG. 11 is a structural diagram of a socket insulating body of the socket connector shown in FIG. 9 according to the embodiment of the present disclosure.
Figure 12:
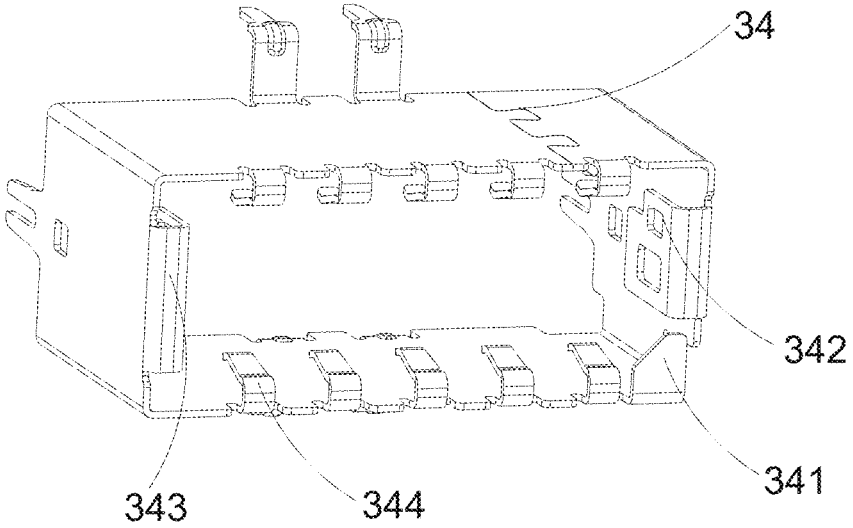
FIG. 12 is a structural diagram of a socket metal shell of the socket connector shown in FIG. 9 according to the embodiment of the present disclosure.

An embodiment of the present disclosure further provides a socket connector. The socket connector connects to the foregoing plug connector. Referring to FIG. 9 to FIG. 12, FIG. 9 is a perspective view of a socket connector according to an embodiment of the present disclosure, FIG. 10 is a space exploded view of the socket connector, FIG. 11 is a structural diagram of a socket insulating body of the socket connector, and FIG. 12 is a structural diagram of a socket metal shell of the socket connector. The socket connector 30 includes a socket insulating body 31, a first socket conductive terminal set 32, a second socket conductive terminal set 33, and a socket metal shell 34. The socket insulating body 31 includes a socket upper wall 31A, a socket lower wall 31B, and two socket sidewalls 31C. The socket upper wall 31A, the socket lower wall 31B, and the two socket sidewalls 31C define a housing space 310. An inner surface of the socket upper wall 31A extends to the housing space to form a first holding portion 311; and an inner surface of the socket lower wall 31B extends to the housing space to form a second holding portion 312. At least one first projection housing slot 31D is defined between one of the two socket sidewalls 31C and the first holding portion 311, and at least another one first projection housing slot 31D is defined between another one of the two socket sidewalls 31C and the first holding portion 311; similarly, at least one second projection housing slot 31E is defined between one of the two socket sidewalls 31C and the second holding portion 312, and at least another one second projection housing slot 31E is defined between another one of the two socket sidewalls 31C and the second holding portion 312. The socket insulating body 31 further includes a socket foolproof portion 313. The first socket conductive terminal set 32 is located on the first holding portion 311, and the second socket conductive terminal set 33 is located on the second holding portion 312. The socket metal shell 34 is used to secure the socket insulating body 31, and the socket metal shell 34 includes a socket reinforcing portion 341 that is fixed upon an external lateral surface of the foolproof portion 313.

The socket metal shell 34 includes a metal upper wall 34A, a metal lower wall 34B, and two metal sidewalls 34C. The two metal sidewalls 34C bend and extend toward the housing space 310 to form bent portions 342 and 343 respectively. The two socket sidewalls 31C of the socket insulating body 31 include two notched portions 314 (the other one is not shown) that house the bent portions, and tail ends of the bent portions 342 and 343 abut against the socket sidewalls 31C. With the socket metal shell 34 including the bent portions 342 and 343, the sidewalls 31C of the socket insulating body 31 including the notched portions 314, and the bent portions and the notched portions being fit together and fastened, a structure of the socket connector 30 is stable, thereby preventing the socket metal shell 34 and the socket insulating body 31 from loosening after a plurality of plugging operations. In this embodiment, the bent portions 342 and 343 are parallel to the metal sidewalls 34C, so that the socket insulating body 31 can be easily fastened to the socket metal shell 34. In another embodiment, the bent portions may be not parallel to the metal sidewalls, or only one bent portion and one notched portion may be included.

The socket foolproof portion 313 obliquely extends from the socket lower wall 31B to the socket sidewall 31C. The notched portions 314 are located above the socket foolproof portion 313. As the socket foolproof portion 313 is positioned corresponding to the stopper block 1112A of the plug connector 10, reverse insertion can be effectively prevented.

There is a grounding spring 344 extending from a front end of the socket metal shell 34 toward the housing space 310. Wherein, the grounding spring 344 is bent and snap-fit to the socket lower wall 31B of the socket insulating body 31. The socket insulating body 31 defines a spring housing slot 315 that houses the grounding spring 344. There are a plurality of grounding springs 344 and a plurality of housing slots 315, and one spring housing slot 315 corresponds to one grounding spring 344.

An embodiment of the present disclosure further provides an electrical connector component, including the plug connector according to any of the foregoing descriptions and the socket connector according to any of the foregoing descriptions. When the plug connector is inserted into the socket connector, a projection of the plug connector is housed in a projection housing slot of the socket connector. Wherein, a stopper block shares a projection housing slot with a projection adjacent to the stopper block. Wherein, the plug connector includes a plug reinforcing portion that is fastened to at least one projection, and the socket connector includes a socket foolproof portion and a socket reinforcing portion that is fastened to an external lateral surface of the foolproof portion. Therefore, a user can easily identify a correct insertion direction, effectively preventing erroneous insertion. In addition, with the plug reinforcing portion being positioned to protect the projection, damage to the connectors may further be mitigated in case of a wrong insertion manner.

Different from the prior art, the plug connector according to the embodiments of the present disclosure includes at least two projections and a plug reinforcing portion that is fastened to at least one projection, and the socket connector includes a socket foolproof portion, at least two projection housing slots and a socket reinforcing portion that is fixed upon an external lateral surface of the foolproof portion. This can effectively prevent erroneous insertion and reduce damage to the connectors in a process of inserting the plug connector into the socket connector.

It should be noted that the specification and accompanying drawings of the present disclosure provide exemplary embodiments of the present disclosure. However, the present disclosure may be implemented by using many different forms, without being limited to the embodiments described in this specification. These embodiments do not constitute additional limitation to content of the present disclosure. These embodiments are provided for the purpose of facilitating more complete and comprehensive understanding of the content disclosed in the present disclosure. In addition, the foregoing technical features may be further combined to form various embodiments other than those listed above. All such embodiments shall be considered falling with the scope recorded in the specification of the present disclosure. Further, a person of ordinary skill in the art may make improvements and variations based on the foregoing descriptions. All such improvements and variations shall fall within the protection scope of the claims of the present disclosure.

What is claimed is:

1. A plug connector, comprising:

an insulating body, comprising a base portion, a tongue plate, at least two projections and a stopper block; the tongue plate extending onward from the base portion, the at least two projections extending from two sidewalls of the tongue plate, and the stopper block positioned on the tongue plate and abutting against an inner side of one of the at least two projections;

a first plug conductive terminal set, fixed upon one side of the tongue plate; and a second plug conductive terminal set, fixed upon the other side of the tongue plate.

2. The plug connector according to claim 1, wherein the insulating body comprises a first insulating body and a second insulating body, the first insulating body comprises a first base portion and a first tongue plate extending onward from the first base portion, the second insulating body comprises a second base portion and a second tongue plate extending onward from the second base portion, the first plug conductive terminal set is located on the first tongue plate, and the second plug conductive terminal set is located on the second tongue plate.

3. The plug connector according to claim 2, wherein the insulating body comprises two co-directional projections extending from two sidewalls of the second tongue plate, the first tongue plate is housed between the two co-directional projections, and the stopper block is positioned on the first tongue plate and abuts against an inner side of one of the two co-directional projections.

4. The plug connector according to claim 3, wherein a front end of the first base portion abuts against the two co-directional projections.

5. The plug connector according to claim 2, wherein a central location of the first base portion defines three first clearance holes that penetrate through the first base portion, a central location of the second base portion defines three second clearance holes that penetrate through the second base portion, and locations of the first clearance holes correspond to locations of the second clearance holes.

6. The plug connector according to claim 1, wherein the plug connector further comprises a plug metal shell, the plug metal shell comprises two sidewalls and an extension portion, the extension portion is positioned on at least one of the two sidewalls and is fastened to an external lateral surface of a projection.

7. The plug connector according to claim 6, wherein the plug metal shell is fastened to the insulating body, the plug metal shell further comprises an upper wall and a lower wall, and the tongue plate and the projections protrude from the upper wall and the lower wall.

8. A plug connector, comprising:

an insulating body, comprising a base portion, a tongue plate, at least two projections and a stopper block; the tongue plate extending onward from the base portion, the at least two projections extending from two sidewalls of the tongue plate, the stopper block positioned on the tongue plate and abutting against an inner side of one of the at least two projections, and a height of the stopper block being lower than a height of the projection adjacent to the stopper block;

a first plug conductive terminal set, fixed upon one side of the tongue plate; and a second plug conductive terminal set, fixed upon the other side of the tongue plate.

9. The plug connector according to claim 8, wherein the insulating body comprises two projections extending co-directionally from the two sidewalls of the tongue plate, and the stopper block is abutting against an inner side of one of the two projections.

10. The plug connector according to claim 8, wherein the insulating body comprises a first insulating body and a second insulating body, the first insulating body comprises a first base portion and a first tongue plate extending onward from the first base portion, the second insulating body comprises a second base portion and a second tongue plate extending onward from the second base portion, the first plug conductive terminal set is located on the first tongue plate, and the second plug conductive terminal set is located on the second tongue plate.

11. The plug connector according to claim 10, wherein the insulating body comprises two co-directional projections extending from two sidewalls of the second tongue plate, the first tongue plate is housed between the two co-directional projections, and the stopper block is positioned on the first tongue plate and abuts against an inner side of one of the two co-directional projections.

12. The plug connector according to claim 11, wherein a front end of the first base portion abuts against the two co-directional projections.

13. The plug connector according to claim 10, wherein the insulating body comprises a projection, the projection extends from a sidewall of the second tongue plate and obliquely corresponds to the stopper block.

14. The plug connector according to claim 10, wherein a central location of the first base portion defines three first clearance holes that penetrate through the first base portion, a central location of the second base portion defines three second clearance holes that penetrate through the second base portion, and locations of the first clearance holes correspond to locations of the second clearance holes.

15. The plug connector according to claim 8, wherein the plug connector further comprises a plug metal shell, the plug metal shell comprises two sidewalls and an extension, the extension portion is positioned on at least one of the two sidewalls and is fastened to an external lateral surface of a projection.

16. The plug connector according to claim 15, wherein the plug metal shell is fastened to the insulating body, the plug metal shell further comprises an upper wall and a lower wall, and the tongue plate and the projections protrude from the upper wall and the lower wall.

17. A plug connector, comprising:

an insulating body, comprising a base portion, a tongue plate and at least four projections; the tongue plate extending from the base portion, and the at least four projections respectively extending from two sidewalls of the tongue plate in two opposite directions;

a first plug conductive terminal set, located on one side of the tongue plate;

a second plug conductive terminal set, located on the other side of the tongue plate; and a plug metal shell, fastened to the insulating body, the plug metal shell comprising a plug reinforcing portion, the plug reinforcing portion fastened to at least one projection of the at least four projections, and extending to an internal lateral surface of the at least one projection.

18. The plug connector according to claim 17, wherein the plug metal shell comprises an upper wall, a lower wall, two sidewalls and an extension portion, the extension portion is positioned on at least one of the two sidewalls and is fastened to an external lateral surface of the at least one projection, the plug reinforcing portion bends and extends towards the internal lateral surface of the at least one projection from the extension portion and sticks to the internal lateral surface of the at least one projection.

19. The plug connector according to claim 18, wherein the plug metal shell comprises two plug reinforcing portions, the insulating body comprises two projections extending towards opposite directions from a same sidewall of the tongue plate, and the two plug reinforcing portions bend and extend towards opposite directions from an extension portion of a same sidewall of the plug metal shell and stick to internal lateral surfaces of the two projections.

20. The plug connector according to claim 18, wherein the insulating body comprises a first insulating body and a second insulating body, the first insulating body comprises a first base portion and a first tongue plate extending from the first base portion, the second insulating body comprises a second base portion and a second tongue plate extending from the second base portion, the first plug conductive terminal set is located on the first tongue plate, and the second plug conductive terminal set is located on the second tongue plate; and four projections respectively extending from two sidewalls of the second tongue plate in two opposite directions, the plug reinforcing portion is fastened to one of the four projections or fastened to two projections located on a same sidewall of the second tongue plate, the plug reinforcing portion extends from one side of the extension portion until covering the projection and then extends towards the internal lateral surface of the projection, a front end of the extension portion does not exceed a front end of the projection, the other side of the extension portion and the sidewall on which the extension portion is positioned define a fastening hole, and a fastening portion that matches the fastening hole is positioned on a sidewall of the second tongue plate.

* * * * *